US005924565A

United States Patent [19]

Colee

[11] Patent Number: 5,924,565

[45] Date of Patent: Jul. 20, 1999

[54] APPLIANCE FOR CONCEALING A HANDGUN

[76] Inventor: Philip S. Colee, 4805 Catalina Dr., Wichita Falls, Tex. 76310

[21] Appl. No.: 09/109,209

[22] Filed: Jun. 30, 1998

[51] Int. Cl.[6] ..... B65D 85/00

[52] U.S. Cl. ..... 206/317; 206/473; 224/911

[58] Field of Search ..... 206/317, 472, 206/473; 224/911, 912, 913; 190/102, 109, 120, 903; 150/113, 114; 70/63

[56] References Cited

U.S. PATENT DOCUMENTS

| | | | |
|---|---|---|---|
| 118,228 | 8/1871 | Frey | 224/911 |
| 2,873,830 | 2/1959 | Wilt | 190/41 |
| 5,172,575 | 12/1992 | Fisher | 70/63 |
| 5,313,733 | 5/1994 | Meade | 206/317 |
| 5,431,970 | 7/1995 | Broun et al. | 206/317 |
| 5,584,424 | 12/1996 | Stava | 224/240 |
| 5,662,219 | 9/1997 | Tschudy et al. | 206/317 |

*Primary Examiner*—Paul T. Sewell
*Assistant Examiner*—Nhan T. Lam
*Attorney, Agent, or Firm*—Jerry C. Ray

[57] ABSTRACT

An appliance for concealing a handgun includes a substantially planar frame of resilient plastic or other material, having dimensions to fit closely inside a cover of a small zippered case such as a notebook case. Integral tabs projecting from either end of the frame engage a pocket inside the cover of the case to hold the frame in place. A holster tab is integral with the body of the frame; the holster tab is shaped and sized to receive a handgun holster spring clip and to hold the holster securely in place. A clip holder tab similarly receives an ammunition clip holder, and is positioned so the clip holder is held adjacent the holster. A handgun is placed in the holster and the case is closed, so the weapon is concealed within the inconspicuous case. Security is improved by a small orifice in the frame near the case's zipper tab; the orifice receives a padlock shackle to lock the case's zipper closed.

6 Claims, 3 Drawing Sheets

APPLIANCE FOR CONCEALING A HANDGUN

CROSS REFERENCE TO RELATED APPLICATIONS

Not Applicable

BACKGROUND OF THE INVENTION

1. Field of the Invention

This invention relates to devices for concealing a handgun within an inconspicuous carrying case, and in particular to support frames which fit within a cover of a small notebook case or the like to provide attachment points for holsters and accessories such as cartridge clip cases.

2. Description of the Related Art

Citizens in most states (33 states as of this writing) are allowed to carry concealed handguns after fulfilling the requirements for a permit. Concealed weapons may be hidden on the body, or off-body as in the present invention. Men often carry a handgun concealed under their clothing, usually in a belt-mounted holster. Shoulder holsters, held in place under a wearer's arm by a system of shoulder straps are used less frequently. Other methods of concealment include ankle holsters, pocket holsters, and articles of clothing having holster-like pockets. Women often carry a concealed weapon in their purse, while persons dressed for out-of-doors may use a body pack or fanny pack as a cache for a concealed weapon.

The presence of a handgun concealed on one's person is often apparent unless some sort of substantial overgarment is worn; a weapon is said to "print" when its outline or shape is visible through clothing. Such evidence of a weapon's presence is a violation of the law in many jurisdictions; i.e., the statutes require that the weapon be effectively concealed from view. Because concealing a full-size weapon is difficult and loss of the concealment may have legal consequences, some may resort to carrying a smaller weapon which is more easily concealed. The problem is exacerbated in those states having hot weather, when the thermometer dictates that clothing be light and breathable. The problem to be addressed, therefore, is that of providing a system of off-body concealment for a full-size weapon; a system independent of how much or how little clothing a person is wearing.

SUMMARY OF THE INVENTION

The present invention provides an easy-to-use device for concealing a holstered handgun and an ammunition clip within an ordinary zippered case such as a field bag, day-planner case, or zippered binder. These cases are widely used and readily available. Such a case, because of its ordinary and mundane appearance, is unlikely to arouse suspicion that it contains a weapon.

Cases like those described in the preceding paragraph have pockets inside the front and back covers. A frame or armature is inserted into an inside pocket of the case, where the frame provides attachment points for a handgun holster and related accessories. Installation of the insert requires no modification of the case, or of the handgun or its holster. The holster and accessory equipment such as ammunition clip holders may be removed from the frame and attached to a user's belt in the ordinary manner.

Made preferably of resilient plastic, the frame includes several uniquely shaped tabs. one or more of the tabs engage a pocket within a zippered case to hold the frame securely in place. Another tab receives the belt clip or belt loop of a holster, so the holster is anchored to the frame and held securely in place. Even with the case unzipped, the holster and handgun cannot slip from within the case, so the weapon is effectively concealed even when the case is closed but not zipped. Having the frame securely anchored to the case facilitates drawing the weapon from its holster.

Because the frame is available in various dimensions to fit specific sizes of zippered cases, a user may choose a frame and case appropriate to the size of weapon to be concealed. Concealment is thus available for a variety of different-sized weapons, and at relatively low cost. Being able to carry a full-size weapon is a decided advantage for an off-duty police officer, for example, who can use the present invention to conceal his duty weapon. Then the officer's most familiar weapon is available if needed, and not some smaller, less familiar handgun chosen because it was more easily concealed.

Another advantage is that the ordinary appearance of the concealed-carry case is unattractive to would-be thieves because such cases generally contain only notes, papers, etc., of little value. Lying on a car seat or tucked into a purse, the case appears to be a common notebook or the like, and as such does not attract attention.

Based on the above, it is an object of this invention to provide an apparatus for converting a compact, zippered case into a container for a concealed handgun.

It is a further object to provide a structure for mounting a holster and ammunition clip inside a cover of a small notebook case.

Further objects are to achieve the above with a device that is compact, durable, simple, efficient, and reliable, yet inexpensive and easy to install and use.

The specific nature of the invention, as well as other objects, uses, and advantages thereof, will clearly appear from the following description and from the accompanying drawings, the different views of which are not necessarily scale drawings.

CATALOG OF THE ELEMENTS

To aid in the correlation of the elements of the invention to the exemplary drawings, the following catalog of the elements is provided:

| | |
|---|---|
| 10 | frame |
| 12 | pocket-engaging tab |
| 14 | holster supporting tab |
| 16 | clip holder supporting tab |
| 17 | notch |
| 18 | case |
| 20 | holster |
| 22 | ammunition clip holder |
| 24 | padlock orifice |

DESCRIPTION OF THE PREFERRED EMBODIMENTS

Figure 1:
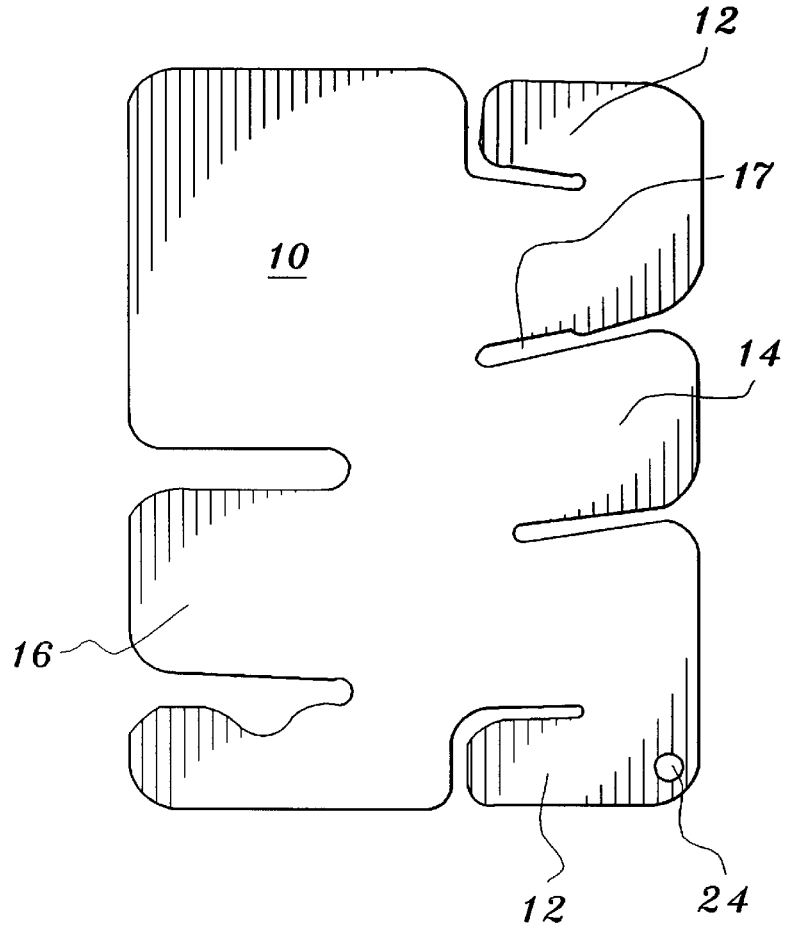
FIG. 1 is a plan view of the frame.
Figure 2:
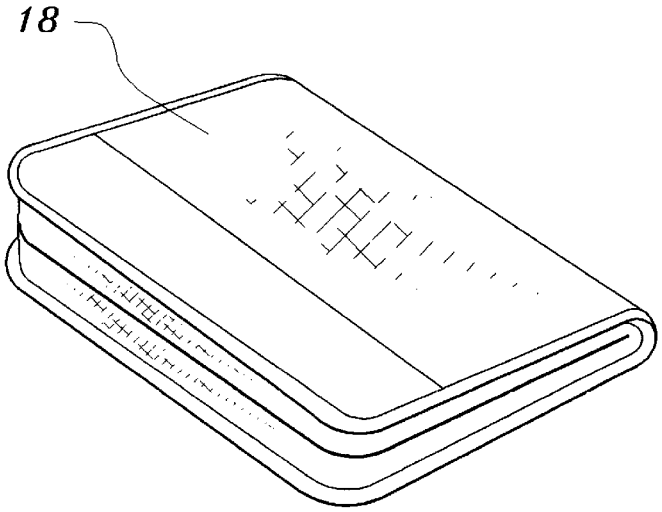
FIG. 2 is a perspective view of the zippered case with its covers closed.
Figure 3:
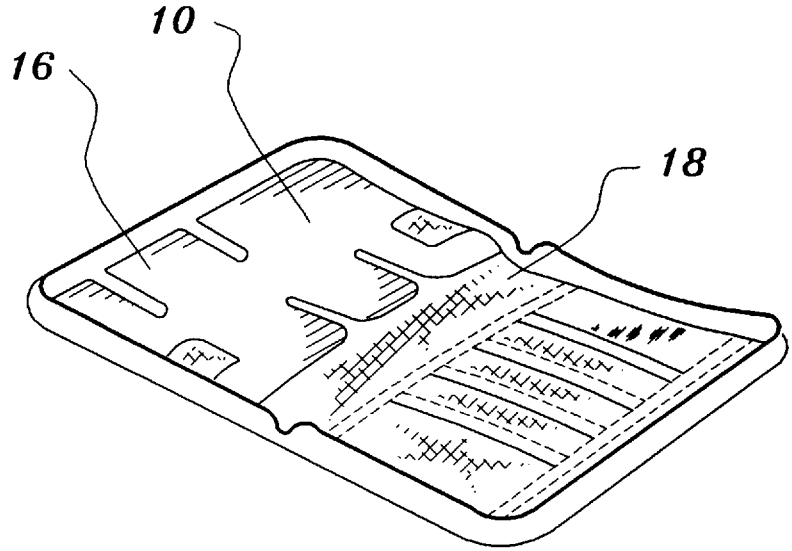
FIG. 3 is a top perspective view of an open case with the frame installed.
Figure 4:
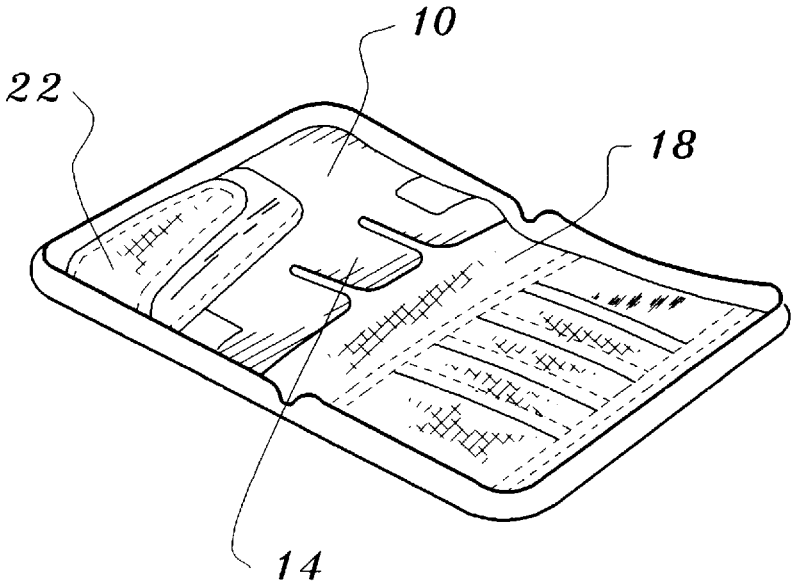
FIG. 4 is a top perspective view, showing an ammunition clip holder installed on the frame.

Referring now to the drawings, FIG. 1 shows a substantially planar frame 10, also referred to herein as an "insert". Frame 10 is made in a variety of sizes; each size frame is dimensioned to fit closely within the cover of a specific brand of day-planner notebook case 18 or the like. (A partial listing of suitable cases appears below.) Referring to FIG. 2, these cases are manufactured of heavy fabric and usually contain several layers of fabric in each cover, so there is no evidence that a weapon is concealed inside. That is, the weapon does not print through the case. Such a notebook case 18 has one or more pockets inside its covers; pocket-engaging tabs 12 slip inside the pocket as the frame 10 is installed, securing it in place. In addition, the perimeter of the frame fits closely against the flexible material which forms the edge of the case. Referring to FIGS. 3 and 4, the close fit of the perimeter of the frame against the cover, in combination with the pocket-engaging tabs 12, anchors frame 10 securely in place.

A suitable material for the frame 10 is a tough, resilient plastic such as polyethylene or polypropylene, about 3/32"–1/8" thick. One specific material suitable for the frame is Kydex®, a strong thermoplastic having a shear strength of 6000 psi and R-94 hardness. Alternate materials include fiberglass, metal, and laminates of plastics and/or other materials. Where plastic is used, the frames may be molded to the appropriate dimensions, although the preferred method of shaping is by laser or water-jet cutters.

Figure 5:
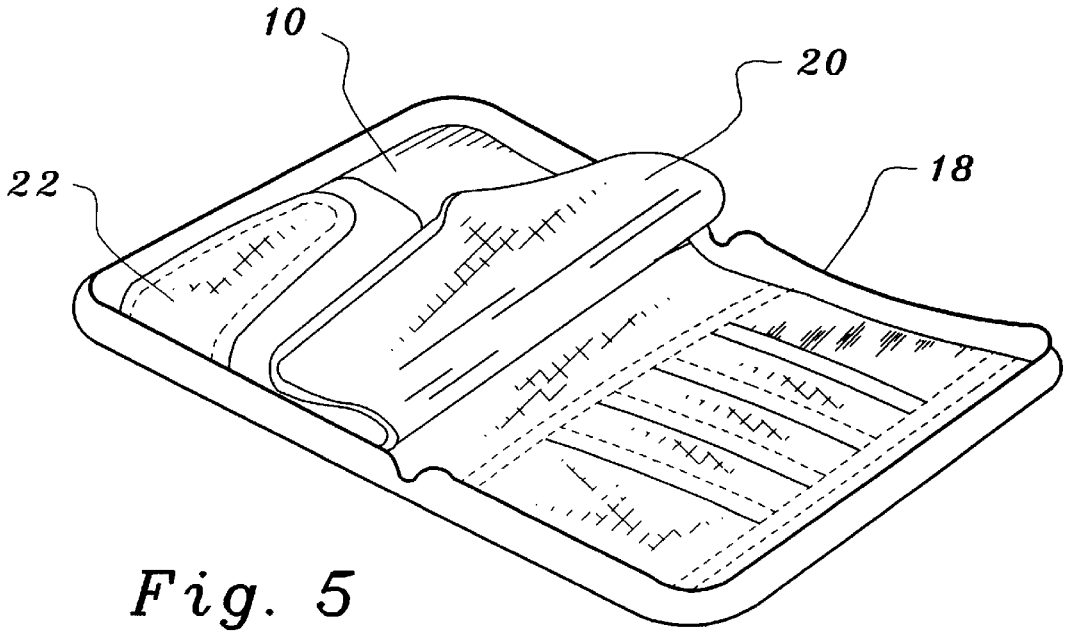
FIG. 5 is a top perspective view, showing a holster and clip holder installed on the frame.
Figure 6:
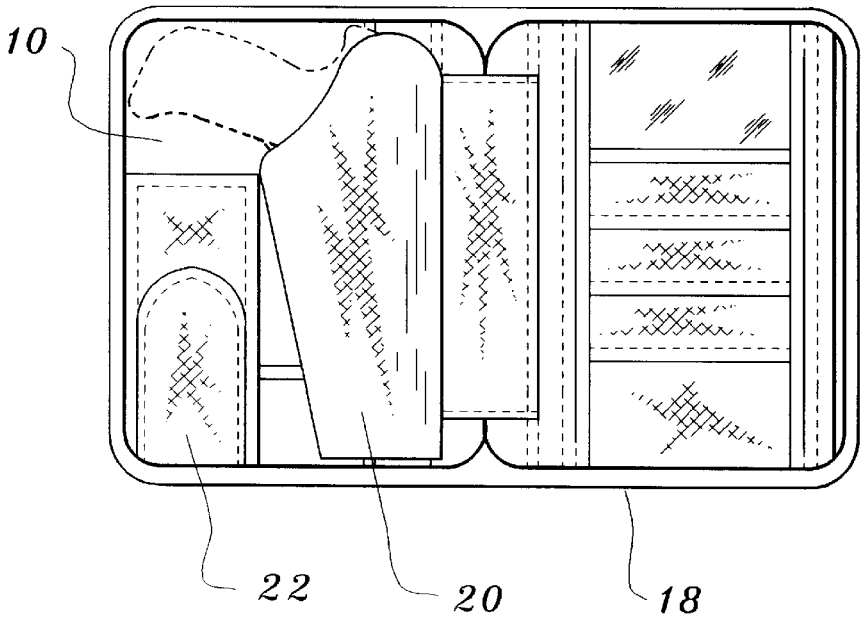
FIG. 6 is a top plan view, showing a handgun in the holster.

Frame 10 acts as a support or foundation within the zippered case 18; the frame's function is to provide an attachment point for a holster 20 and a holder 22 for an ammunition clip. As shown in FIGS. 1 and 3, holster supporting tab 14 and clip holder supporting tab 16 extend from the main body of the frame 10. Holster tab 14 provides an attachment point for a holster 20 so the holster is held in the position shown in FIG. 5. Clip holder support tab 16 engages clip holder 22 and keeps it in position adjacent the holster, as shown in FIGS. 5 and 6. Where the frame is designed to accommodate a revolver, clip holder tab 16 is shaped to support either a belt slide with cartridge loops or a case for a cartridge speedloader.

A widely used type of holster has an integral spring clip (not shown) that is normally used for attaching the holster to a person's belt. Such a holster spring clip has a shoulder or ridge extending from its end; the shoulder is arranged so as to engage a wearer's belt, keeping the holster securely in place. In the present invention, the shoulder on the spring clip serves a similar purpose, keeping the holster 20 securely in place on holster-supporting tab 14. Another widely used type of holster has a belt loop rather than a spring clip. With the latter type of holster, the belt loop is engaged by holster-supporting tab 14.

To keep the holster in place on its supporting tab, a notch 17 is provided on the frame surface adjacent the supporting tab. Referring to FIG. 1, notch 17 is a widening of the slit between tab 14 and frame 10. When fully inserted into the slit, the holster's belt clip or belt loop slips into the notch and is restrained there, so that the holster and its handgun are held in position.

Frame 10 has an additional feature for use in situations where it is desirable to keep the case locked. Padlock orifice 24 is a small opening in the body of the frame, shown in FIG. 1; it is sized to receive the shackle of a small padlock. Located in the corner of the frame, padlock orifice 24 is near the position of the zipper tab when the case is zippered shut.

A padlock shackle is passed through orifice 24 and through an existing opening in the zipper tab. The body of the padlock remains outside the case, but is nestled in the concavity at the corner of the case, where it is partially hidden.

Examples of specific cases which are suitable for the use described above include: (1) Mead's Five-Star Fat Little Zipper Planner (50830, 6"×5½"); (2) Mead's Five-Star XL Zipper Planner (50866, 9⅛"×6½"); (3) Mead's Five-Star Zippered XL Notefolio (33578, 10½"×6¾"); (4) Mead's Reebok Student Day Planner (50194, 8⅞"×6¼"); (5) The Nature Company's Planes, Trains, & Automobiles field bag (two pockets, 10½"×7½"); and (6) Brookstone's Travel Organizer (202945, two main pockets, 10½"×7½").

Examples of suitable holsters include Uncle Mike's brand "Inside-the-Pant" holsters, distributed by the Michaels of Oregon Co., of Oregon City, Oreg. These holsters are made from fabric, have a spring clip as described above, and are available in a variety of sizes for both left- and right-handed shooters. Holsters made from fabric are preferred because they are lighter and less bulky than leather.

As an example of a specific combination, the Smith & Wesson model 915 semi-automatic pistol works well with Uncle Mike's size 5, left hand, inside-the-waistband holster. This pistol and holster combination, with the holster anchored to its support tab on the frame, fit neatly within the zippered cover of the Mead Student Planner notebook case.

The restrictive description and drawings of the specific examples above do not point out what an infringement of this patent would be, but are to enable one skilled in the art to make and use the invention. Various modifications can be made in the construction, material, arrangement, and operation, and still be within the scope of my invention. The limits of the invention and the bounds of the patent protection are measured by and defined in the following claims.

I claim as my invention:

1. An appliance for containing a concealed handgun, comprising:

a closeable case, a substantially planar frame having dimensions to fit closely within a cover of said case, said frame having means for said frame within said case, including at least one pocket-engaging tab for engaging a pocket inside a cover of said case, and said frame having means for receiving a handgun holster.

2. The invention as described in claim 1, further comprising:

said means for receiving a handgun holster including a holster tab integral with a body of said frame, said holster tab being positioned on said frame so that said holster is held in an orientation to said case to facilitate drawing the handgun from said holster.

3. An appliance for concealing a handgun, comprising:

a closeable case, a substantially planar frame having dimensions to fit closely within a cover of said case, said frame being made of a resilient material, at least one pocket-engaging tab for securing said frame inside a cover of said case, a holster tab integral with a body of said frame for receiving a handgun holster, said holster tab being positioned on said frame to hold the holster in an orientation to said case to facilitate drawing the handgun from said case, and a clip tab integral with a body of said frame for receiving an ammunition clip holder.

4. The invention as described in claim 3, further comprising:

said frame having an orifice in at least one corner thereof to receive a padlock shackle for locking a zipper of said case in a closed position.

5. A method for concealing a handgun, comprising the following steps:

forming a substantially planar frame of resilient plastic, providing on said frame an integral holster tab for securing a holster, providing on said frame at least one integral pocket-engaging tab for securing said frame to said case, placing said frame inside a cover of said case so that said pocket-engaging tab is inserted into a pocket inside said cover, attaching a holster to said holster tab, placing a handgun in said holster, and closing said case.

6. The method as described in claim 5, further comprising the following steps:

providing on said frame an integral ammunition clip holder tab for securing an ammunition clip holder, and placing on said clip tab a holder for an ammunition clip.

* * * * *